US007817945B2

(12) United States Patent
Mase et al.

(10) Patent No.: US 7,817,945 B2
(45) Date of Patent: Oct. 19, 2010

(54) DEVELOPER CARTRIDGE AND METHOD OF RECYCLING THE DEVELOPER CARTRIDGE

(75) Inventors: Soichiro Mase, Handa (JP); Takeyuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 281 days.

(21) Appl. No.: 12/145,117

(22) Filed: Jun. 24, 2008

(65) Prior Publication Data

US 2008/0317511 A1 Dec. 25, 2008

(30) Foreign Application Priority Data

Jun. 25, 2007 (JP) ..... 2007-166671

(51) Int. Cl.
*G03G 15/08* (2006.01)

(52) U.S. Cl. ..... 399/262

(58) Field of Classification Search ..... 399/262
See application file for complete search history.

(56) References Cited

U.S. PATENT DOCUMENTS 5,870,652 A 2/1999 Kanamori et al.
5,913,097 A 6/1999 Nakano et al.
6,131,008 A 10/2000 Kanamori et al.
2007/0140764 A1* 6/2007 Shirai ..... 399/358

FOREIGN PATENT DOCUMENTS

| | | |
|---|---|---|
| JP | 60-121473 | 6/1985 |
| JP | 60-146271 | 8/1985 |
| JP | 07-199622 | 8/1995 |
| JP | 09-222783 | 8/1997 |
| JP | 10-240008 | 9/1998 |
| JP | 2003-316139 | 11/2003 |
| JP | 2005-156837 | 6/2005 |

* cited by examiner

*Primary Examiner*—David M Gray
*Assistant Examiner*—G. M. Hyder
(74) *Attorney, Agent, or Firm*—Banner & Witcoff, Ltd.

(57) ABSTRACT

A developing cartridge and method of recycling a developing cartridge are provided. The developing cartridge includes a cartridge housing that is configured to accommodate developer. The cartridge housing includes a first opening for discharging the developer from the cartridge housing; and a second opening for accommodating the developer into the cartridge housing. The developing cartridge further includes a deflector that is configured to generate a swirling flow of air in the cartridge housing. The method of recycling the developing cartridge includes injecting air into the second opening such that the air is deflected by the deflector and refilling the developing cartridge with developer.

17 Claims, 7 Drawing Sheets

DEVELOPER CARTRIDGE AND METHOD OF RECYCLING THE DEVELOPER CARTRIDGE

CROSS-REFERENCE TO RELATED APPLICATIONS

This application claims priority from Japanese Patent Application No. 2007-166671 filed on Jun. 25, 2007, the entire subject matter of which is incorporated herein by reference.

TECHNICAL FIELD

The present invention relates to developer cartridges and, more particularly, to developer cartridges provided in an image forming apparatus, and to a method of recycling the developer cartridges.

BACKGROUND

JP-A-10-240008 describes a related art developer cartridge, in which developer is accommodated in a cylindrical resin member. A developer supply opening is provided in a center portion along a cylindrical surface of the resin member. During image formation, developer is supplied to a photosensitive drum from the developer supply opening.

An opening is formed in one side of the resin member. This opening is closed by a cap.

The related developer cartridge can be recycled when an amount of developer remaining in the resin member is equal to or less than a predetermined amount. Specifically, the opening is opened by removing the cap, and air is injected into the resin member from the opening to thereby discharge the residual developer from the developer supply opening together with the air. Then, new developer is filled into the resin member through the opening in the side of the resin member.

SUMMARY

It is an aspect of the present invention to provide a developer cartridge capable of effectively discharging residual developer during recycling of the developer cartridge.

BRIEF DESCRIPTION OF THE DRAWINGS

FIGS. 1A to 1C are exemplary schematic views of a developer cartridge according to an exemplary embodiment of the present invention, in which FIG. 1A is an exemplary perspective view of the developer cartridge as viewed from a diagonal back right side, FIG. 1B is a partial sectional view of a peripheral part of an inside side wall on a right side of the developer cartridge shown in FIG. 1A, and FIG. 1C is a perspective view of the inside side wall on the right side of the developer cartridge shown in FIG. 1A as viewed from a diagonal back left side;

FIGS. 4A and 4B are schematic views of a developer cartridge according to another exemplary embodiment of the present invention, in which FIG. 4A is an exemplary perspective view of the developer cartridge as viewed from a diagonal back right side, and FIG. 4B is a partial sectional view of a peripheral part of an inside side wall on a right side of the developer cartridge shown in FIG. 4A;

FIGS. 6A to 6C are schematic views of the developer cartridge according to still another exemplary embodiment of the present invention, in which FIG. 6A is a schematic perspective view of the inside housing of the developer cartridge for explaining a manner in which a swirling flow is generated in the inside housing, FIG. 6B is a partial sectional view of a peripheral part of an inside side wall on a right side of the developer cartridge of FIG. 6A, and FIG. 6C is a right side view of the inside side wall on the right side of the developer cartridge of FIG. 6A; and FIGS. 7A to 7C are schematic perspective views of the developer cartridge according to still another exemplary embodiment of the developer cartridge of the present invention in which the developer cartridge is viewed from the diagonal back right side, in which FIG. 7A shows a state where an inside housing is in an opened position, FIG. 7B shows a state where the inside housing is in a closed position, and FIG. 7C shows a state where the inside housing is in a discharge position.

DETAILED DESCRIPTION

General Overview

Figure 1A:
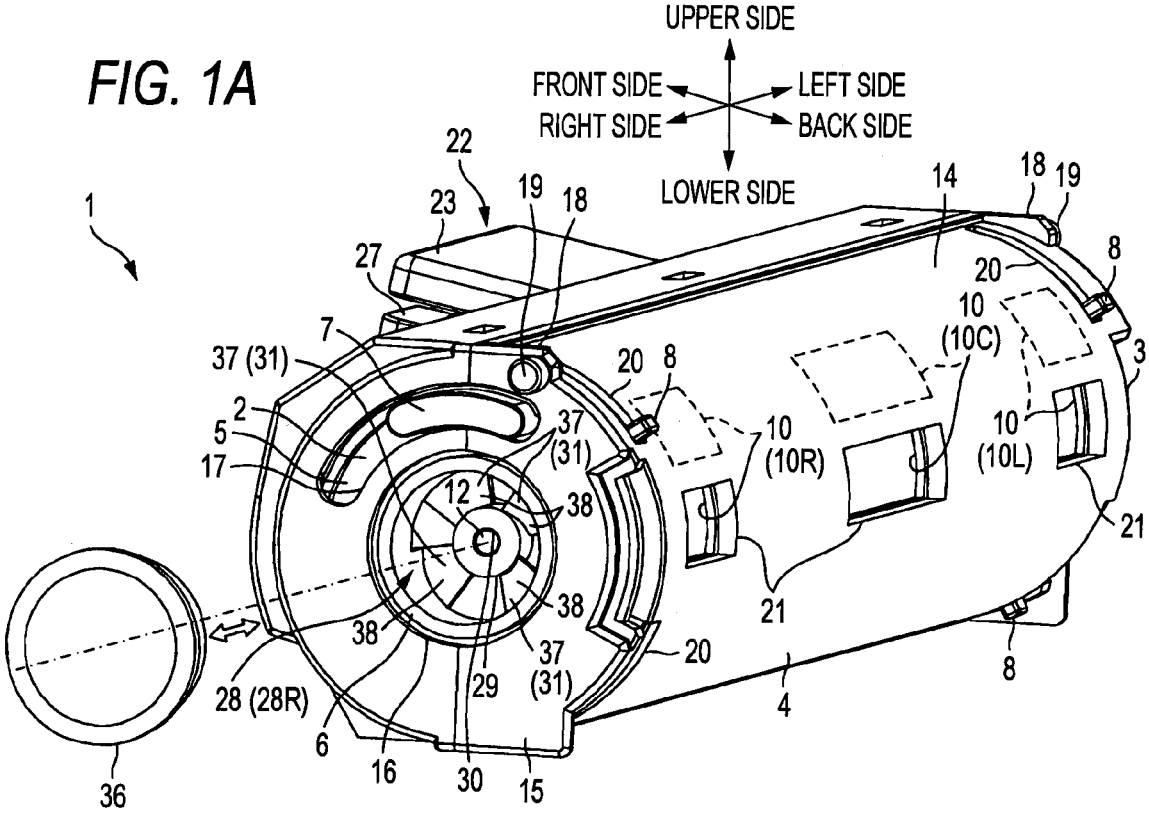

When the related art developer cartridge is recycled, it is necessary that the residual developer be completely discharged from the developer cartridge. However, in the related art developer cartridge, even though air is injected into the resin member, the residual developer may not be sufficiently discharged from the developer supply opening.

According to an aspect of the present invention, there is provided a developer cartridge comprising a cartridge housing that is configured to accommodate developer, the cartridge housing comprising a first opening for discharging the developer from the cartridge housing; and a second opening for accommodating the developer into the cartridge housing; and a deflector that is configured to generate a swirling flow of air in the cartridge housing.

According to another aspect of the present invention, there is provided a developer cartridge comprising a cylindrical housing that is configured to accommodate developer; at least one rectangular first opening provided in a wall of the cylindrical housing for discharging the developer from the cylindrical housing; a second opening, which is provided at an axial end of the cylindrical housing, for accommodating the developer into the cylindrical housing; and a deflector that is configured such that when air is injected into the second opening, the deflector generates a swirling flow of air in the cylindrical housing.

According to still another aspect of the present invention, there is provided a developer cartridge comprising a cartridge housing that is configured to accommodate developer; a first opening for discharging the developer from the cartridge housing; a second opening for accommodating the developer into the cartridge housing; and means for, when air is injected into the cartridge housing, generating a swirling flow of air in an interior of the cartridge housing.

According to still another aspect of the present invention, there is provided a method of recycling a developing cartridge, the developing cartridge comprising a cartridge housing that is configured to accommodate developer, a first opening for discharging the developer from the cartridge housing, a second opening for accommodating the developer into the cartridge housing, and a deflector, the method comprising injecting air into the second opening such that the air is deflected by the deflector; and refilling the developing cartridge with developer.

Exemplary Embodiments

Exemplary embodiments of the invention will be described with reference to the drawings.

(Developer Cartridge)

A developer cartridge according to exemplary embodiments of the present invention is detachably provided in an image forming apparatus. The developer cartridge accommodates developer to be supplied to a developer carrier of the image forming apparatus. An example of the developer is positively charged, non-magnetic one component toner. However, different developers may be used with the developer cartridge according to the exemplary embodiments of the present invention.

Referring to FIG. 1A, a developer cartridge 1 has a substantially cylindrical shape, and is elongated along the central axis thereof. The developer cartridge 1 has a double housing structure including an inside housing 2 accommodating developer and an outside housing 3 accommodating the inside housing 2. The inside housing 2 and the outside housing 3 constitutes a cartridge housing. In the description of the developer cartridge 1, outside passage openings 21 described later are oriented so as to be opened toward substantially a horizontal direction. In the developer cartridge 1, the side where the outside passage openings 21 are provided will be referred to as the back side (back face side), and the side where a grasp part 22 described later is provided will be referred to as the front side (front face side). The direction of the longitudinal direction of the developer cartridge 1 will be referred to as the width direction (right-left direction). Specifically, in FIG. 1A, the near side of the drawing sheet in the direction perpendicular to the direction that the drawing sheet extends will be referred to as the right side, and the far side of the drawing sheet in the direction perpendicular to the drawing sheet will be referred to as the left side. For convenience of explanation, the up-down and front-back directions in FIG. 3 do not coincide with those of the other figures (the same applies to FIGS. 5 and 6 described later).

(1) Inside Housing

Figure 2A:
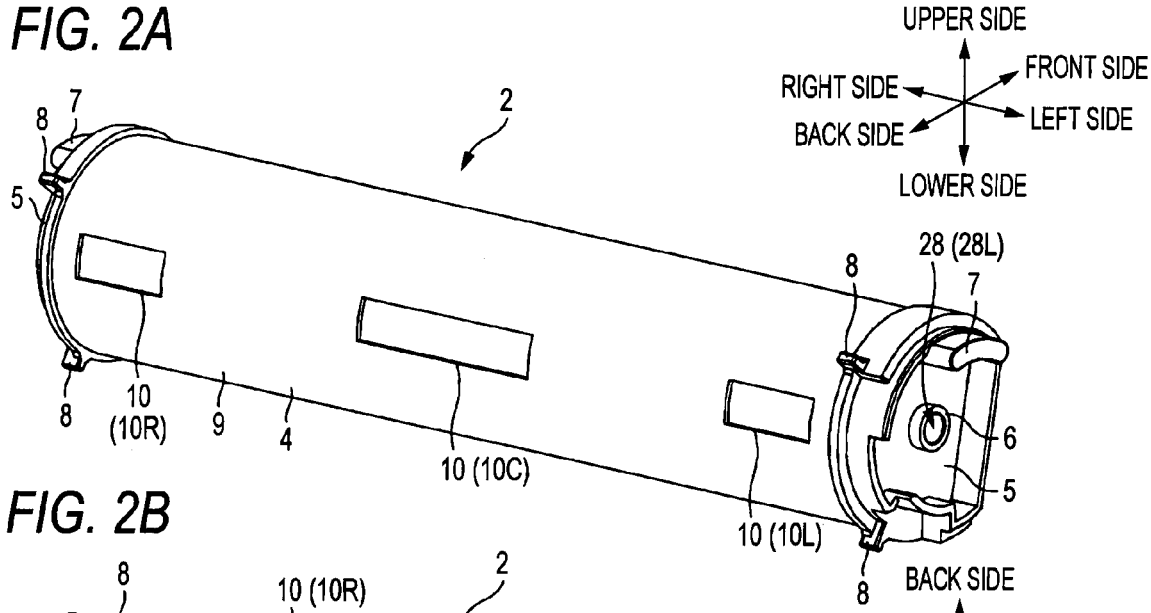
FIG. 2A is a perspective view of the inside housing of the developer cartridge shown in FIG. 1A as viewed from the diagonal back left side.

As shown in FIG. 2A, the inside housing 2 is integrally provided with a substantially cylindrical inside peripheral wall 4 that extends in the width direction and two substantially disk-form inside side walls 5 that close end portions, in the width direction, of the inside peripheral wall 4 of the developer cartridge 1.

Figure 2B:
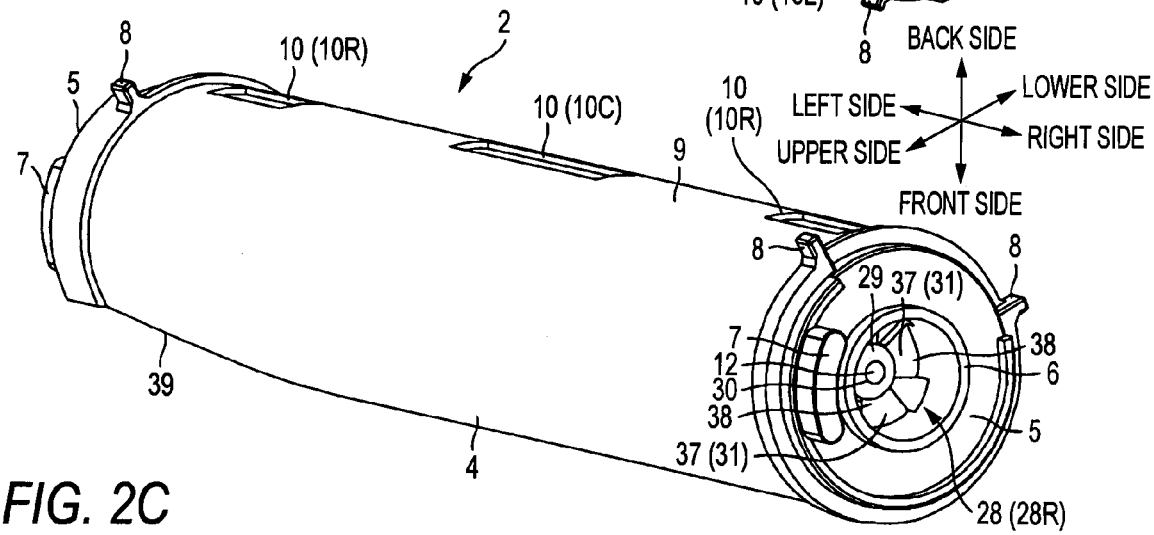
FIG. 2B is a perspective view of the inside housing of FIG. 2A as viewed from a diagonal upper right side.

The inside side walls 5 each have, at the center of a circle thereof, a boss part 6 having a tube shape and protruding outward in the width direction. Each boss part 6 has a round hole 28 that passes through the boss part 6 and the inside side wall 5 in the width direction. As shown in FIGS. 2A and 2B, the round hole 28 of the boss part 6 of the inside side wall 5 on the right side (referred to as a right round hole 28R functioning as an example of a second opening) is formed in a right end portion of the inside housing 2, and has a larger diameter than the round hole 28 of the inside side wall 5 on the left side (referred to as a left round hole 28L). Moreover, as shown in FIG. 1A, the right round hole 28R is normally closed by a cap 36 being fitted therein. The cap 36 is detachable from and attachable to the right inside side wall 5 in the directions of the illustrated arrow. In the boss part 6 on the right side, a shaft insertion part 29 and support parts 31 as an example of a deflector are provided on the left side of the right round hole 28R.

The shaft insertion part 29 has a disk-form concentric with the right round hole 28R and has a smaller diameter than the right round hole 28R. At the center of circle of the shaft insertion part 29, a round hole that passes through the shaft insertion part 29 in the width direction (referred to as a shaft insertion hole 30) is formed.

Figure 1B:
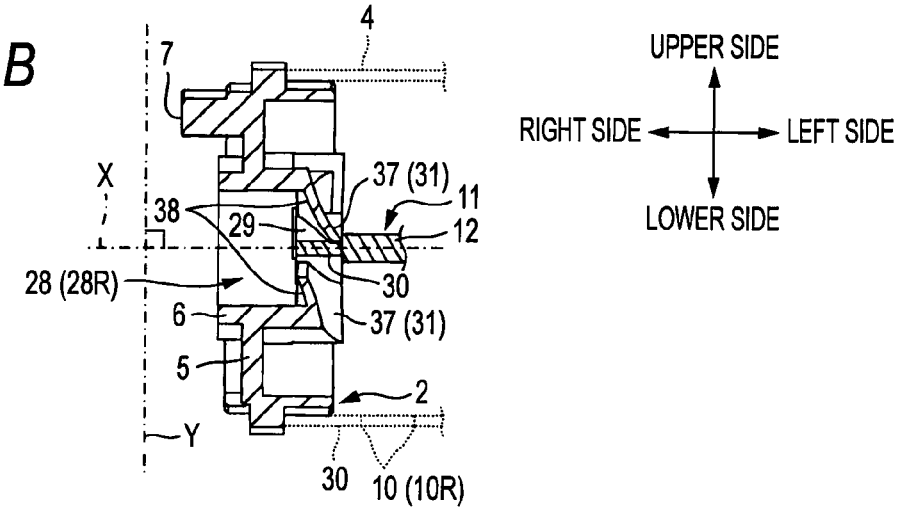
Figure 1C:
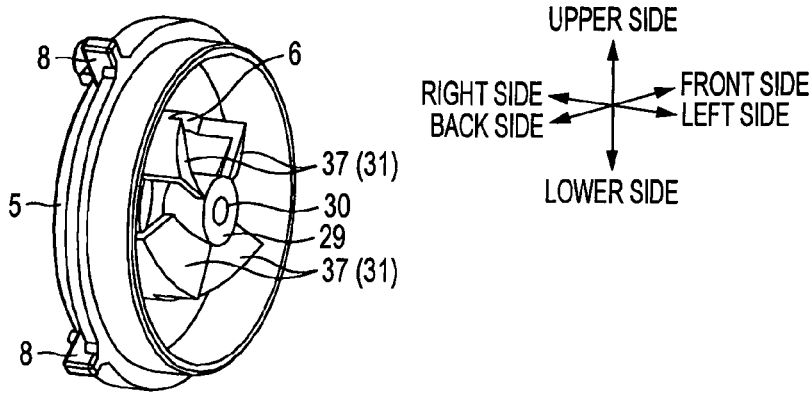

The plurality of, e.g., four, support parts 31 have a thin plate form substantially triangular when viewed from the right side, and are spaced uniformly in the circumferential direction on the peripheral surface of the shaft insertion part 29. Specifically, as shown in FIGS. 1A to 1C, the support parts 31 each extend outward from the peripheral surface of the shaft insertion part 29 in the radial direction of the shaft insertion part 29 so as to increase in width when viewed from the right side. Hereinafter, this wider part of the support parts 31 will be referred to as a radial part 37. The support parts 31 bend rightward to be connected to the inner surface of the boss part 6. The radial part 37 is inclined with respect to both of a first plane including a width direction X (see FIG. 1B) and a second plane including a direction Y orthogonal to the width direction X (see FIG. 1B). Specifically, the radial part 37 is inclined like a blade of a propeller or a screw so as to extend leftward while extending in the same circumferential direction about the shaft insertion part 29 (referring to FIG. 1C, counterclockwise when viewed from the left side). Here, the right side surface of the radial part 37 (i.e., the surface exposed to the outside from the right round hole 28R on the outside in the width direction) will be referred to as a guide surface 38 as an example of the inclined surface. The guide surface 38 is also inclined with respect to both of the above-mentioned first and second planes.

As shown in FIG. 2A, the inside side walls 5 each have a slide protrusion 7 at an upper part thereof on the outside of the boss part 6 in the radial direction. Each slide protrusion 7 has an arc shape along the peripheral surface of the inside side wall 5 when viewed from a side, and protrudes outward from the surface of the inside side wall 5 in the axial direction.

The inside side walls 5 each have, in a back part thereof, a plurality of nipping protrusions 8 that protrude from the peripheral end portion in the radial direction. The nipping protrusions 8 are disposed at a distance away from each other in the circumferential direction on the peripheral end surface of each inside side wall 5.

In the inside peripheral wall 4, inside passage openings 10 as an example of a first opening are formed in a surrounded part 9 (i.e., in the surface of the cartridge housing) surrounded by the nipping protrusions 8 (e.g., a total of four nipping protrusions 8 in this exemplary embodiment) disposed on both sides in the width direction.

The inside passage openings 10 are formed in an upper part of the surrounded part 9. Specifically, three inside passage openings 10 are formed so as to be spaced from each other in the width direction.

The inside passage openings 10 each have a substantially rectangular shape that is elongated in the width direction when viewed from the back side. The inside passage opening 10 situated in a center portion in the width direction is approximately twice as long in the width direction as the other inside passage openings 10. For convenience of explanation, of the three inside passage openings 10, the inside passage opening 10 situated in the left end portion of the inside housing 2 (in other words, in a position farthest from the right round hole 28R in the width direction) will be referred to as a left inside passage opening 10L. Accordingly, the inside passage opening 10 situated in the right end portion of the inside housing 2 will be referred to as a right inside passage opening 10R, and the inside passage opening 10 situated between the right inside passage opening 10R and the left inside passage opening 10L will be referred to as a center inside passage opening 10C.

Referring to FIGS. 1B and 2B, the shaft insertion part 29 and the support parts 31 are situated on the right side of the right inside passage opening 10R in the width direction. Since the shaft insertion part 29 and the support parts 31 are situated on the left side of the right round hole 28R as described above, the shaft insertion part 29 and the support parts 31 are situated between the right round hole 28R and the inside passage opening 10 (the right inside passage opening 10R) in the inside housing 2.

Figure 2C:
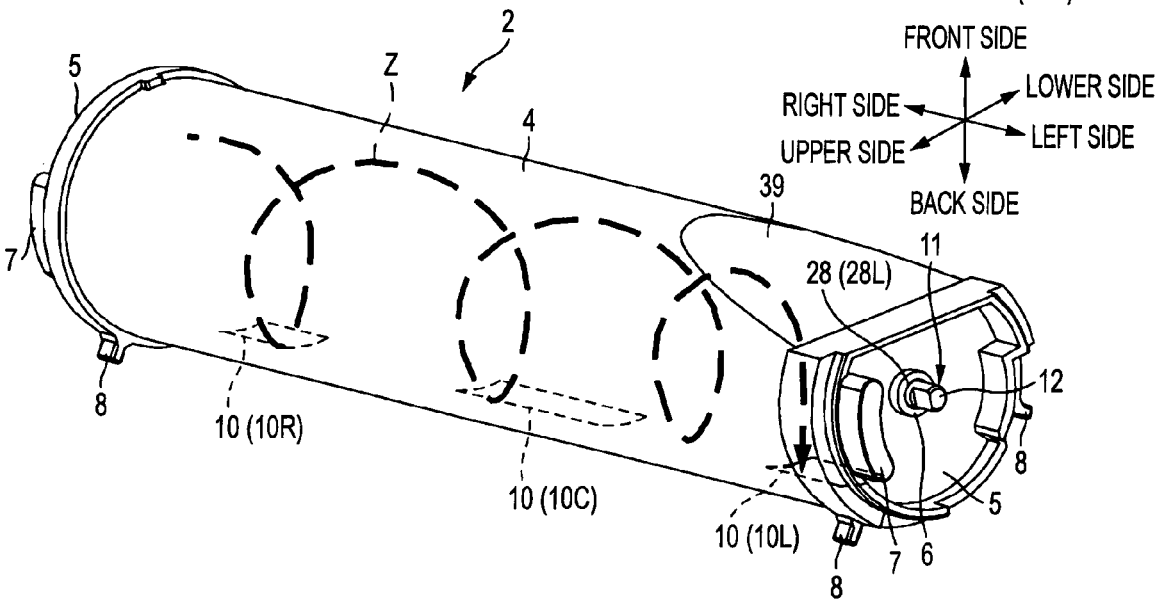
FIG. 2C is a perspective view of the inside housing of FIG. 2A as viewed from a diagonal upper left side.

As shown in FIGS. 2B and 2C, a part of the inside peripheral wall 4 opposed to the left inside passage opening 10L in the orthogonal direction orthogonal to the width direction (i.e., in the radial direction of the inside peripheral wall 4) is inclined. Hereinafter, this part will be referred to as an opposed part 39. Specifically, the opposed part 39 is an inclined surface that is inclined from the right side (the side of the right round hole 28R) toward the left side (the side of the left inside passage opening 10L) in a direction approaching the left inside passage opening 10L. Alternatively, the inside peripheral wall 4 itself may be generally straight as long as the part opposed to the left inside passage opening 10L in the radial direction on the inner wall surface of the inside peripheral wall 4 is inclined as the opposed part 39.

Figure 3:
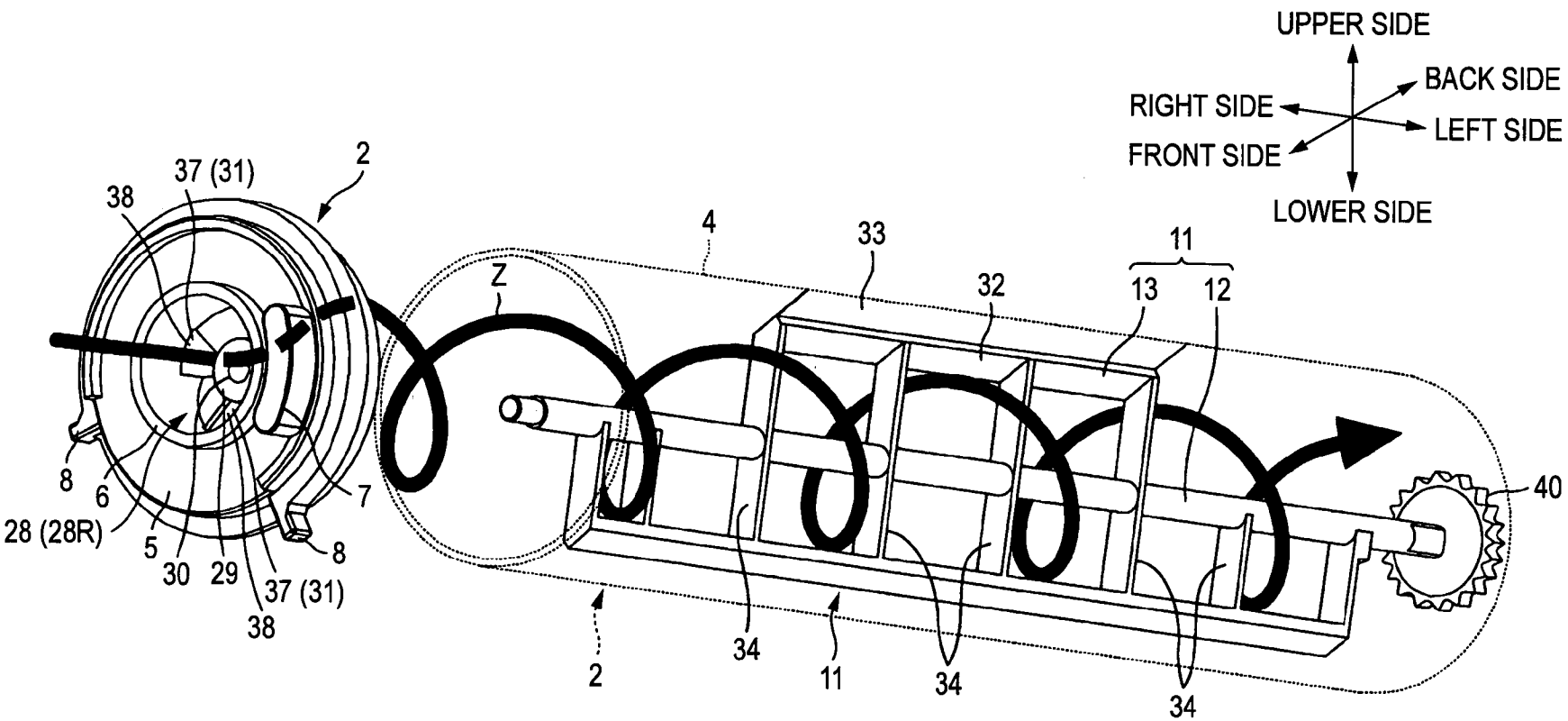
FIG. 3 is a schematic perspective view of the inside housing of the developer cartridge of FIG. 1A for explaining a manner in which a swirling flow is generated in the inside housing.

As shown in FIG. 3, an agitator 11 is provided in the inside housing 2. The agitator 11 has an agitator shaft 12 extending in the radial direction and an agitating part 13 extending outward from the agitator shaft 12 in the radial direction. The agitator shaft 12 functions as an example of a rotation shaft.

The agitator shaft 12 is rotatably held by the inside side walls 5 by the left end portion thereof being inserted in the left round hole 28L (see FIG. 2C) and the right end portion thereof being inserted in the shaft insertion hole 30 (see FIG. 1B). Specifically, the left end portion of the agitator shaft 12 is held by the boss part 6 (see FIG. 2C). The right end portion of the agitator shaft 12 is held by the shaft insertion part 29, the support parts 31, and the boss part 6 (see FIG. 1A). The support parts 31 extend in a direction outwardly away from the agitator shaft 12 in the radial direction in a condition of holding the agitator shaft 12 (see FIG. 1A).

The left end portion of the agitator shaft 12 protrudes leftward so as to be exposed from the left round hole 28L (see FIG. 2C). An agitator gear 40, as an example of a transmitting part, is attached to the exposed left end portion of the agitator shaft 12 so that the agitator gear 40 does not rotate relatively to the agitator shaft 12. The agitator gear 40 is provided on the left end portion of the inside housing 2. When the developer cartridge 1 is attached to the image forming apparatus, the agitator gear 40 meshes with a gear (not shown) provided in the image forming apparatus.

The agitating part 13 has a frame 32 and an agitating blade 33. The frame 32 has a rectangular frame shape. The inside of the frame 32 is partitioned into a plurality of rectangular spaces by subframes 34 extending outward from the agitator shaft 12 in the radial direction. The agitating blade 33 is, for example, a rectangular film having flexibility, and is attached to the outside end portion, in the radial direction, of the frame 32.

During image formation, the driving force from a motor (not shown) of the image forming apparatus is applied to the agitator 11 (the agitator shaft 12 and the agitating part 13) through the gear (not shown) provided in the image forming apparatus and the agitator gear 40. Thereby, the agitator 11 is rotated. The developer in the inside housing 2 is agitated by the rotating agitator 11 (specifically, the agitating blade 33).

(2) Outside Housing

As shown in FIG. 1A, the outside housing 3 is slightly larger in the width direction and the radial direction than the inside housing 2 in order to rotatably accommodate the inside housing 2. The outside housing 3 is integrally provided with a substantially cylindrical outside peripheral wall 14 that extends in the width direction and two substantially disk-form outside side walls 15 that close the end portions, in the width direction, of the outside peripheral wall 14.

While having angular portions at the upper and front sides of the peripheral surface thereof, the outside peripheral wall 14 has a cylindrical inner surface.

In the outside side wall 15 on the right side, a circular boss hole 16 that receives the boss part 6 is formed. Although not shown, in the outside side wall 15 on the left side, an exposure hole for exposing the agitator gear 40 is formed. The agitator gear 40 can mesh with the above-mentioned gear (not shown) of the image forming apparatus through the exposure hole (not shown).

A slide hole 17 in which the slide protrusion 7 is inserted is formed in an upper part of each outside side wall 15. The slide hole 17 is opposed to the slide protrusion 7 in the width direction. The slide hole 17 has an arc shape when viewed from a side, and is longer than the slide protrusion 7.

An upper side fixed part 18 protruding backward is formed on an upper back portion of the peripheral end surface of each outside peripheral side wall 15. A positioning boss 19 protruding outward in the width direction is provided on a back end portion of the upper side fixed part 18. When the developer cartridge 1 is attached to the image forming apparatus (not shown), the positioning boss 19 is fitted in a groove or the like provided on the image forming apparatus side. Thereby, the developer cartridge 1 is positioned in the image forming apparatus (not shown).

In the outside peripheral wall 14, a plurality of, e.g., four, elongated holes 20 in which the nipping protrusions 8 are inserted, respectively, are formed in both end portions in the width direction. The elongated holes 20 are opposed to the nipping protrusions 8 in the radial direction. The elongated holes 20 have a substantially rectangular shape that extends in the up-down direction when viewed from the back side.

In the outside peripheral wall 14, the outside passage openings 21 are formed between the four elongated holes 20 (between the upper two elongated holes 20 and the lower two elongated holes 20).

Specifically, three outside passage openings 21 are formed so as to be spaced from each other in the width direction in correspondence with the three inside passage openings 10, respectively. The outside passage openings 21 have substantially the same shapes as the corresponding inside passage openings 10.

On the front side of the outside peripheral wall 14, a grasp part 22 is provided at a center portion in the width direction.

The grasp part 22 has a substantially rectangular upper grasp plate 23 protruding frontward from the upper side of the outside peripheral wall 14 and a lower grasp plate 27 extending substantially parallel to the upper grasp plate 23 at a distance therefrom below the upper grasp plate 23. Although not shown, the lower grasp plate 27 is integrally provided with a latching arm extending downward from the lower grasp plate 27. A latching claw (not shown) having a hook shape in cross section is provided on the lower end portion of the latching arm. The lower grasp plate 27, the latching arm (not shown), and the latching claw (not shown) are swingably held by the outside peripheral wall 14 below the upper grasp plate 23. Between the upper grasp plate 23 and the lower grasp plate 27, a compression spring (not shown) that presses the upper grasp plate 23 and the lower grasp plate 27 in a direction that increases the distance therebetween is interposed.

When the developer cartridge 1 is attached to the image forming apparatus (not shown), the developer cartridge 1 is held by nipping the upper grasp plate 23 and the lower grasp plate 27. At this time, the above-mentioned compression spring is compressed. Thereafter, the upper grasp plate 23 and the lower grasp plate 27 are released from the nipped condition after the developer cartridge 1 is attached to the image forming apparatus (not shown), and thus the latching claw (not shown) of the latching arm engages with a groove or the like provided on the image forming apparatus side by the restoring force of the compression spring. Thereby, the developer cartridge 1 is fixed in the image forming apparatus (not shown).

(3) Relative Positions of Inside Housing and Outside Housing, and Relative Movement of Inside Housing The inside housing 2 is rotatably accommodated in the outside housing 3.

Specifically, the inside housing 2 is inserted into the outside housing 3 so that the peripheral surface of the inside peripheral wall 4 (see FIG. 2A) is circumferentially slidable on the inner surface of the outside peripheral wall 14.

In the boss hole 16 of each outside side wall 15, the corresponding boss part 6 is rotatably held. In the boss hole 16 of the outside side wall 15 on the right side, the cap 36 is exposed to the outside from the boss part 6. In the slide holes 17, the corresponding slide protrusions 7 are inserted. The slide protrusions 7 protrude outward from the slide holes 17 in the width direction in a condition of being loosely fitted in the slide holes 17. In the elongated holes 20, the corresponding nipping protrusions 8 are inserted. The nipping protrusions 8 protrude outward from the elongated holes 20 in the radial direction in a condition of being loosely fitted in the elongated hole 20.

The inside housing 2 is allowed to move (rotate) relatively to the outside housing 3 about the boss parts 6 between a closed position where the inside passage openings 10 are not opposed to the outside passage openings 21 and an opened position where the inside passage openings 10 are opposed to the outside passage openings 21.

When the inside housing 2 is in the closed position, although not shown, the slide protrusions 7 are situated in the front end portions of the slide holes 17, and the nipping protrusions 8 are situated in the upper end portions of the elongated holes 20. The inside passage openings 10 (indicated by a dashed line in FIG. 1A) are situated above the outside passage openings 21. The inside passage openings 10 are closed by the part of the outside peripheral wall 14 above the outside passage openings 21. In other words, the inside passage openings 10 are closed by the outside housing 3. The developer cartridge 1 is attached to or detached from the image forming apparatus (not shown) when the inside housing 2 is in the closed position.

Under this condition, the slide protrusions 7 are pressed backward. This pressing is actually performed by a non-illustrated actuator provided in the image forming apparatus (not shown). Thereby, the inside housing 2 moves (rotates) relatively to the outside housing 3 in a direction that the inside passage openings 10 approach the outside passage openings 21 (downward). Then, as shown in FIG. 1A, the slide protrusions 7 slide from the front end portion toward the back end portion in the respective slide holes 17, and the nipping protrusions 8 slide from the upper end portion toward the lower end portion in the elongated holes 20. Then, when the slide protrusions 7 abut the rear ends of the slide holes 17 and the nipping protrusions 8 abut the lower ends of the elongated holes 20, the inside housing 2 is situated in the opened position.

When the inside housing 2 is situated in the opened position, the slide protrusions 7 are situated in the back end portions of the slide holes 17 and the nipping protrusions 8 are situated in the lower end portions of the elongated holes 20. Thus, the inside passage openings 10 are opposed to the corresponding outside passage openings 21 and these openings communicate with each other to open. In other words, the inside passage openings 10 are opened by the outside housing 3. While the developer cartridge 1 is attached to the image forming apparatus (not shown), the nipping protrusions 8 of each inside side wall 5 nip a non-illustrated shutter provided on the image forming apparatus side. This shutter opens and closes a receiving opening (not shown) of the image forming apparatus. Then, the nipping protrusions 8 on each inside side wall 5 open the shutter in response to the rotation of the inside housing 2 to the opened position, so that the receiving opening (not shown) is opened. Thereby, during image formation, the developer in the inside housing 2 situated in the opened position can be supplied to the developer carrier by way of the inside passage openings 10 and the outside passage openings 21 opposed to each other and the opened receiving opening (not shown).

In contrast, the slide protrusions 7 are pressed frontward with the inside housing 2 being in the opened position. This pressing is also performed by the above-mentioned actuator (not shown). Thereby, the inside housing 2 rotates relatively to the outside housing 3 in a direction that the inside passage openings 10 are separated from the outside passage openings 21 (upward). The slide protrusions 7 slide from the back end portion toward the front end portion in the respective slide holes 17, and the nipping protrusions 8 slide from the lower end portion toward the upper end portion in the respective elongated holes 20. When the slide protrusions 7 abut the front ends of the slide holes 17 and the nipping protrusions 8 abut the upper ends of the elongated holes 20, the inside housing 2 is situated in the closed position. Under the condition where the developer cartridge 1 is attached to the image forming apparatus (not shown), the nipping protrusions 8 of each inside side wall 5 close the above-mentioned shutter (not shown) in response to the rotation of the inside housing 2 to the closed position. Thereby, the above-mentioned receiving opening (not shown) is closed.

(4) Recycling of Developer Cartridge

When a predetermined amount of the developer contained in the inside housing 2 is used by image formation, the developer cartridge 1 needs to be replaced. In such a case, the used developer cartridge 1 is sometimes recycled. Here, the recycling of the developer cartridge 1 denotes that the developer that remains (sometimes referred to as residual developer) is completely discharged from the developer cartridge 1 and new developer is filled into the inside housing 2. When the developer cartridge 1 is recycled, the inside housing 2 remains accommodated in the outside housing 3.

Specifically, as shown in FIG. 1A, first, the inside housing 2 is rotated to the opened position to open the inside passage openings 10. Then, the cap 36 is removed to open the right round hole 28R. Then, a nozzle (not shown) coupled to an air compressor or the like is inserted into the right round hole 28R, and compressed air is injected into the inside housing 2 from the right round hole 28R.

The injected air passes between the support parts 31 while impinging on the guide surfaces 38 of the support parts 31. At this time, by the impingement of the air on the guide surfaces 38, the direction of the air flow is deflected by the guide surfaces 38 and thus the air flows along the guide surfaces 38, that is, the direction of the air flow is inclined with respect to both of the first plane and the second plane. This deflection generates a swirling motion of the injected air within the developer cartridge 1, as shown for example in FIGS. 2C and 3 and described in more detail below.

As mentioned above, the first plane is a plane including the width direction (see the width direction X in FIG. 1B), and the axial direction of the agitator shaft 12 extending in the width direction is also included in the first plane. The second plane is a plane including the direction orthogonal to the axial direction of the agitator shaft 12 (see the direction Y of FIG. 1B), that is, the radial direction of the agitator shaft 12. For this reason, as shown in FIG. 3, the flow direction of the air contacting the guide surfaces 38 is deflected so as to be inclined with respect to both of the axial direction of the agitator shaft 12 and the radial direction of the agitator shaft 12. Thereby, a swirling flow Z that moves leftward while swirling about the agitator shaft 12 (see the thick arrow in FIG. 3) is generated within the inside housing 2. Here, since the radial parts 37 of the support parts 31 having the guide surfaces 38 are inclined so as to extend leftward while extending counterclockwise when viewed from the left side (see FIG. 1C) as described above, the swirling direction of the swirling flow Z is the clockwise direction when viewed from the right side.

Thereby, in the inside housing 2, the developer (residual developer) adhering to the inner surface of the inside peripheral wall 4 and the corners of the part of connection of the inside side walls 5 and the inside peripheral wall 4 comes off because of the centripetal force of the swirling flow Z, and is carried on the swirling flow Z to be discharged from the developer cartridge 1 through the inside passage openings 10 and the outside passage openings 21. Specifically, as shown by the broken line of FIG. 2C, the swirling flow Z containing the residual developer flows leftward within the inside housing 2 and then reaches the opposed part 39. When the swirling flow Z contacts the opposed part 39 and flows along the inclination of the opposed part 39, the direction of the air flow is deflected toward the left inside passage opening 10L, and the swirling flow Z is discharged from the left inside passage opening 10L. Additionally, it is possible for the swirling flow Z to be discharged from the inside passage openings 10 other than the left inside passage opening 10L before reaching the opposed part 39.

After the residual developer is discharged in this manner, the inside housing 2 is rotated to the closed position to close the inside passage openings 10, and new developer is filled into the inside housing 2 from the right round hole 28R. Then, as shown in FIG. 1A, the right round hole 28R is closed by the cap 36 to complete the recycling of the developer cartridge 1.

As described above, the developer cartridge 1 can be recycled by which the developer remaining in the inside housing 2 is discharged through the inside passage openings 10 and then new developer is filled into the inside housing 2 through the right round hole 28R.

The developer cartridge 1 has the support parts 31 as an example of the deflector in order to deflect the injected air to generate the swirling flow Z. Accordingly, the swirling flow Z can be generated in the inside housing 2 by blowing the air into the inside housing 2 through the right round hole 28R (see FIG. 3).

Specifically, the support parts 31 extend in a direction outwardly away from the agitator shaft 12 in the radial direction, and the guide surfaces 38 inclined with respect to both of the first plane and the second plane are formed on the support parts 31. Thus, when the air blown into the inside housing 2 from the right round hole 28R passes the support parts 31, the direction of the air flow is deflected by the contact of the air with the guide surfaces 38 so that the air flows along the guide surfaces 38, that is, the direction of the air flow is inclined with respect to both of the axial direction and the radial direction of the agitator shaft 12. Thereby, the swirling flow Z about the agitator shaft 12 can be generated in the inside housing 2 by the support parts 31 as shown in FIG. 3. While only one support part 31 is enough to generate the swirling flow Z, a plurality of support parts 31 can generate a plurality of swirling flows Z simultaneously. Thus, it is possible to increase the swirling effect by adding additional support parts 31.

Accordingly, the residual developer in the inside housing 2, for example, the developer adhering to the inner wall surface of the inside housing 2 and the developer adhering to the corners of the inside housing 2, can be effectively discharged from the inside passage opening 10 by carrying the developer on the swirling flow Z as shown in FIG. 2C. In addition, even though the inside passage openings 10 are formed only in positions such as center portions in the width direction which the developer in the corners on both sides in the width direction is difficult to reach in the inside housing 2, the developer in the corners can be effectively discharged by the swirling flow Z.

Consequently, the residual developer can be effectively discharged during recycling of the developer cartridge 1.

Moreover, the support parts 31 are disposed between the inside passage opening 10 (the right inside passage opening 10R) and the right round hole 28R in the inside housing 2 (see FIGS. 1B and 2B). Thus, the support parts 31 can be disposed comparatively near the right round hole 28R, so that the swirling flow Z can be generated at a comparatively early stage with reliability by the air blown from the right round hole 28R. Since the support parts 31 are disposed between the inside passage opening 10 and the right round hole 28R, the swirling flow Z can be effectively discharged from the inside passage opening 10 together with the residual developer in the inside housing 2.

Moreover, as shown in FIGS. 2B and 2C, on the inner wall surface of the inside housing 2 (i.e., the inside peripheral wall 4), the opposed part 39 opposed to the left inside passage opening 10L in the radial direction is inclined in the direction approaching the left inside passage opening 10L from the right side (i.e., the side of the right round hole 28R) toward the left side (i.e., the side of the left inside passage opening 10L). Therefore, the swirling flow Z, which has reached the side of the left inside passage opening 10L from the side of the right round hole 28R in the radial direction, is directed to the left inside passage opening 10L by the contact with the opposed part 39, so that the developer carried on the swirling flow Z can be effectively discharged from the left inside passage opening 10L.

Moreover, as shown in FIG. 3, the driving force can be transmitted to the agitator 11 from the agitator gear 40 provided on the left end portion of the agitator shaft 12 in the inside housing 2. The right round hole 28R is formed in the right end portion of the inside housing 2. Accordingly, the size of the right round hole 28R can be made larger than that of the case where the right round hole 28R is formed in the left end portion of the inside housing 2 where the agitator gear 40 is provided.

Additional Exemplary Embodiments (1) First Modification

Figure 4A:
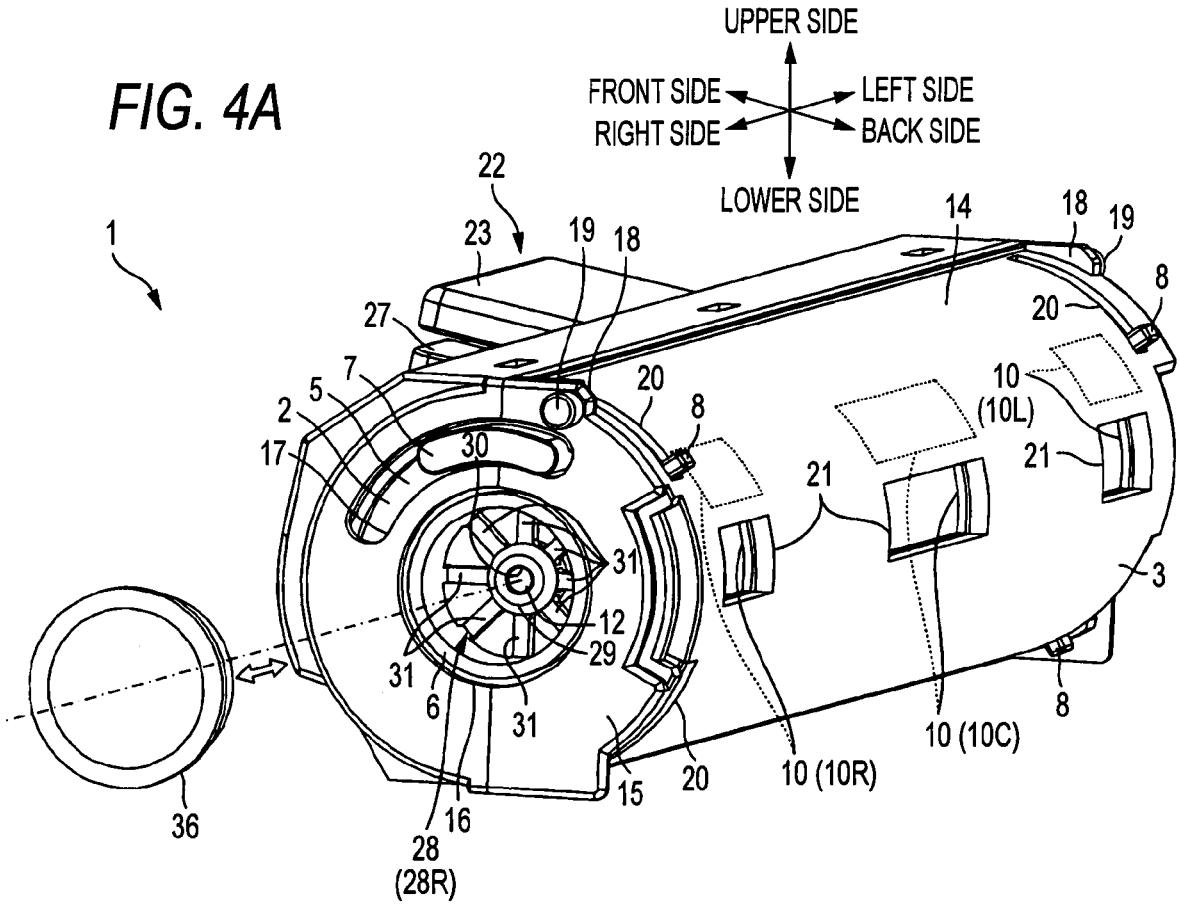
Figure 4B:
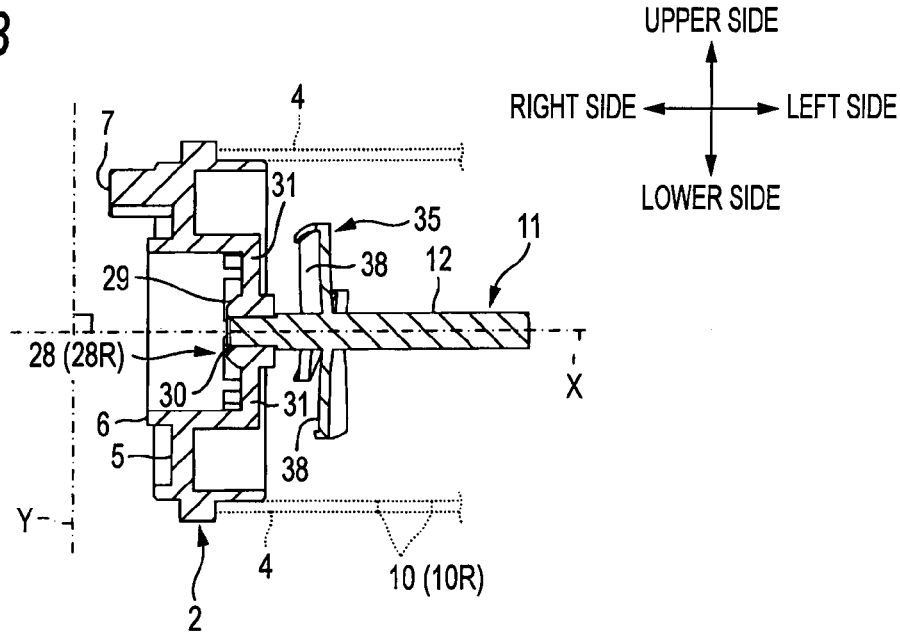
Figure 5:
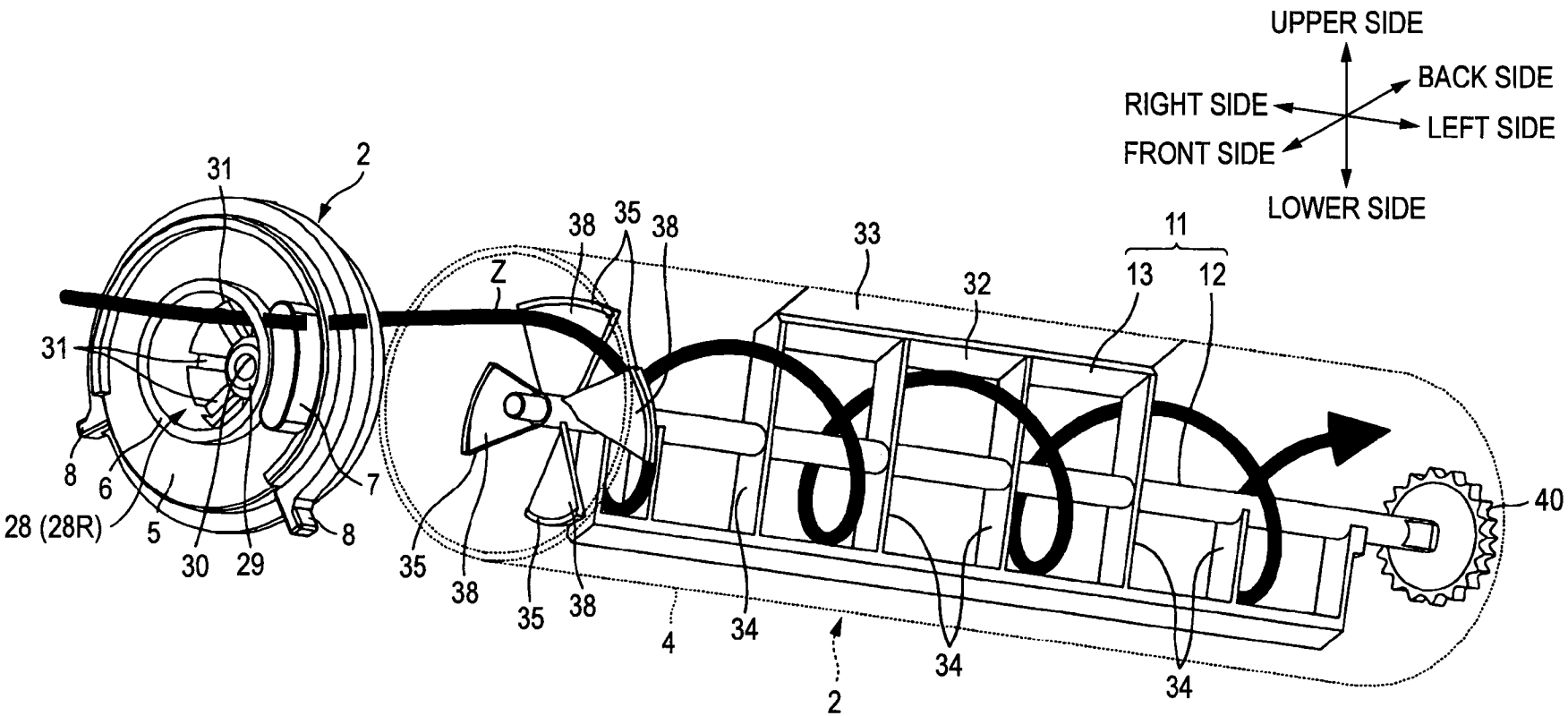
FIG. 5 is a schematic perspective view of the inside housing of the developer cartridge of FIG. 4A.

Referring to FIGS. 4A and 4B and 5, a developer cartridge according to another exemplary embodiment of the present invention will be described.

In order to generate the swirling flow Z, blade parts 35 shown in FIGS. 4A, 4B and 5 may be used either instead of the support parts 31 or in combination with the support parts 31.

The blade parts 35 have a shape similar to that of the radial parts 37 of the support parts 31 (see FIG. 1A). The plurality of, e.g., four, blade parts 35 are rotatably held by the agitator shaft 12 in the inside housing 2, and are opposed to the right round hole 28R in the radial direction in the vicinity of the right round hole 28R. These blade parts 35 are uniformly spaced in the circumferential direction of the agitator shaft 12.

As shown in FIG. 4B, similar to the radial parts 37 of the support parts 31, the blade parts 35 are inclined with respect to both of a first plane including the width direction X (i.e., in the axial direction of the agitator shaft 12) and a second plane including the direction Y orthogonal to the width direction X (i.e., in the radial direction of the agitator shaft 12). Specifically, as shown in FIG. 5, the blade parts 35 are inclined so as to extend leftward while extending in the same circumferential direction about the agitator shaft 12 (referring to FIG. 5, clockwise when viewed from the right side). A guide surface 38 is formed on the right side surface of each blade part 35 so as to be inclined with respect to both of the first plane and the second plane.

Accordingly, when air is blown into the inside housing 2 from the right round hole 28R, the direction of the air flow is deflected, as in the exemplary embodiment described above, by the contact of the air with the guide surfaces 38 when the air passes the blade parts 35. Thereby, the swirling flow Z about the agitator 12 can be generated in the inside housing 2 by the blade parts 35 functioning as an example of the deflector. While only one blade part 35 is enough to generate the swirling flow Z, a plurality of blade parts 35 can generate a plurality of swirling flows Z simultaneously.

Alternatively, the blade parts 35 and the agitator 11 may be integrally provided. Accordingly, a parts count can be reduced.

The blade parts 35 may also be detachable from and attachable to the agitator 11 (i.e., from the agitator shaft 12). In this case, the blade parts 35 are attached to the agitator shaft 12 when the developer cartridge 1 is recycled.

Moreover, it is advantageous if the blade parts 35 are also disposed between the inside passage opening 10 (the right passage opening 10R) and the right round hole 28R (see FIG. 4B) similar to the location of the support parts 31 described above. Thereby, the swirling flow Z can be effectively discharged from the inside passage opening 10 together with the residual developer in the inside housing 2 while the swirling flow Z can be generated in a comparatively early stage with reliability.

(2) Second Modification

Figures 6A, 6B, 6C:
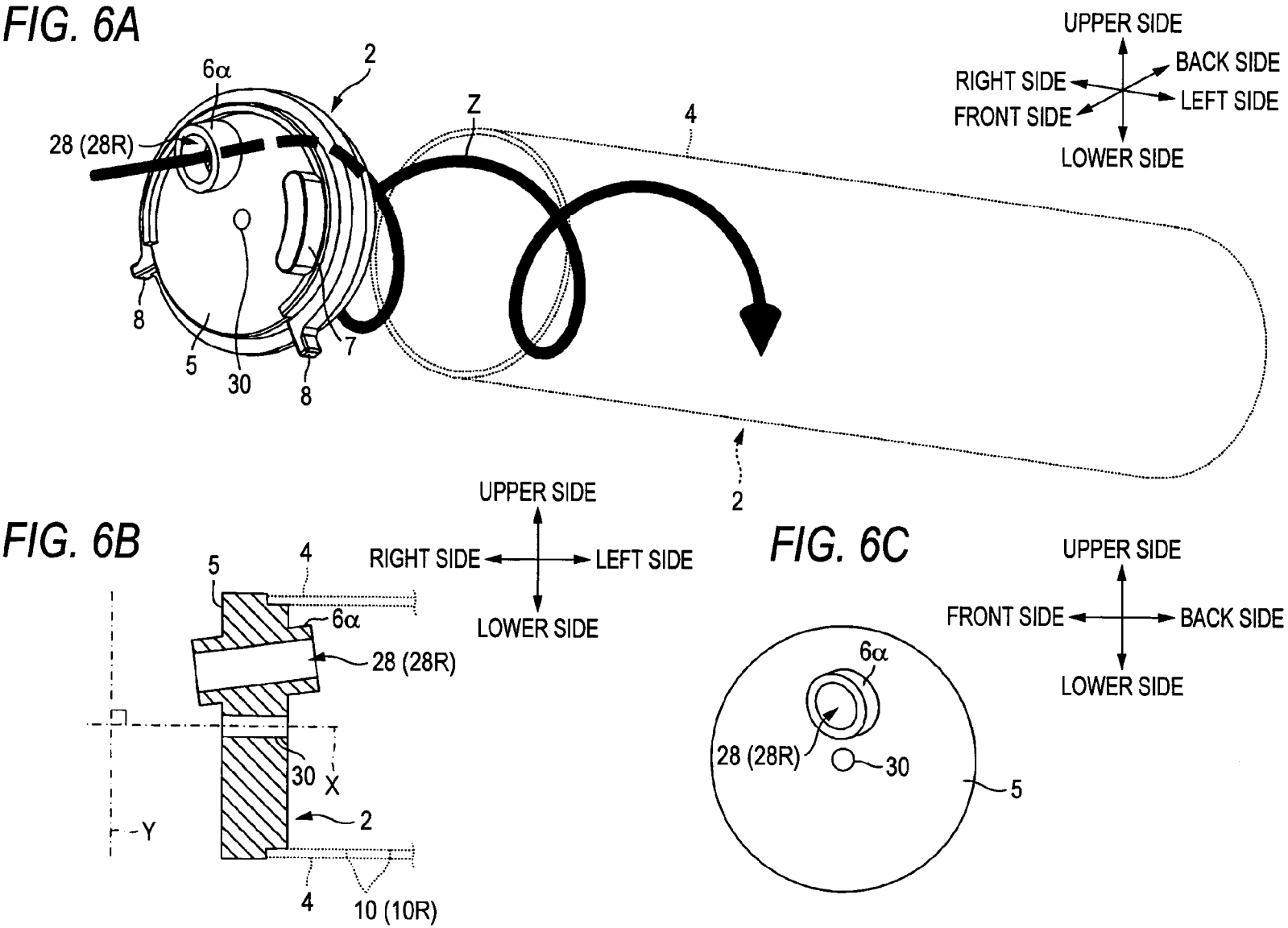

Referring to FIGS. 6A, 6B, and 6C, a developer cartridge according to still another exemplary embodiment of the present invention will be described.

In order to generate the swirling flow Z, an air injection portion 6*a* shown in FIGS. 6A, 6B and 6C may be provided either instead of the support parts 31 or the blade parts 35, or in combination therewith.

The air injection portion 6*a* is formed in the right inside side wall 5 at a position apart from the center of circle of right the inside side wall 5 (see FIG. 6C), and is inclined with respect to the inside side wall 5. Specifically, as shown in FIG. 6B, the air injection portion 6*a* is a circular tube extending so as to be inclined with respect to both of a first plane including the width direction X and a second plane including the direction Y orthogonal to the width direction X (see also FIG. 6C). The air injection portion 6*a* diagonally extends upward and backward toward the left side. An inside end portion (i.e., a left end portion) of the air injection portion 6*a* in the axial direction extends to the inside of the inside housing 2 so as to protrude from the surface of the right inside side wall 5 (see FIG. 6B), so that the right round hole 28R and the inside housing 2 communicate with each other.

In this exemplary embodiment, the air injection portion 6*a* does not function as the center of rotation (i.e., a point of support) of the inside housing 2 because the air injection portion 6*a* is located apart from the center of the circle of the inside side wall 5. That is, at the right inside side wall 5, a separately provided boss part (not shown) is held by the boss hole 16 of the outside side wall 15 (see FIG. 1A).

When the air blew into the inside housing 2 through the right round hole 28R passes through the air injection portion 6*a*, the direction of the air flow is deflected such that the air flows along the inclination of the air injection portion 6*a*, that is, the direction of the air flow is inclined with respect to both of the width direction X (see FIG. 6B) and the orthogonal direction Y (see FIG. 6B). Thereby, by the air injection portion 6*a*, the swirling flow Z about the axis in the width direction can be generated in the inside housing 2 as shown in FIG. 6A. Thus, the air injection portion 6*a* functioning as an example of the deflector serves to deflect the air entering the inside housing 2.

It is advantageous if the air injection portion 6*a* is disposed between the inside passage opening 10 (i.e., the right inside passage opening 10R) and the right round hole 28R similar to the location of the support parts 31 and the blade parts 35 (see FIG. 6B). Specifically, the air injection portion 6*a* having the right round hole 28R formed therein is situated on the right side of the right inside passage opening 10R. Thereby, the swirling flow Z can be effectively discharged from the inside passage opening 10 together with the residual developer in the inside housing 2 while the swirling flow Z can be generated in a comparatively early stage with reliability.

(3) Third Modification

Figure 7A:
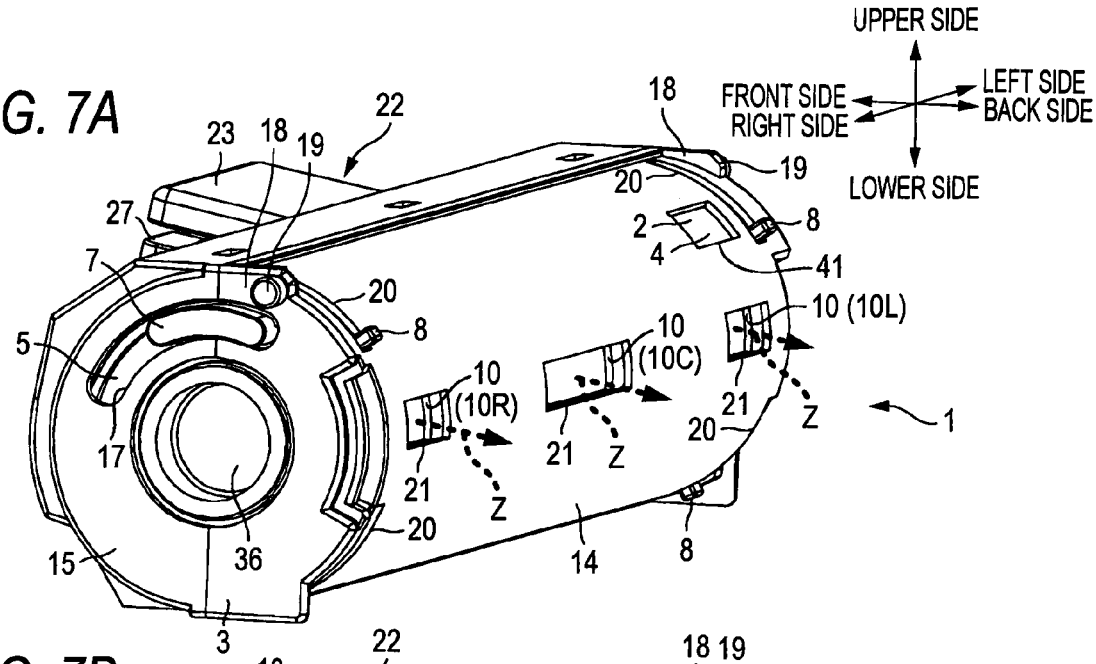
Figure 7B:
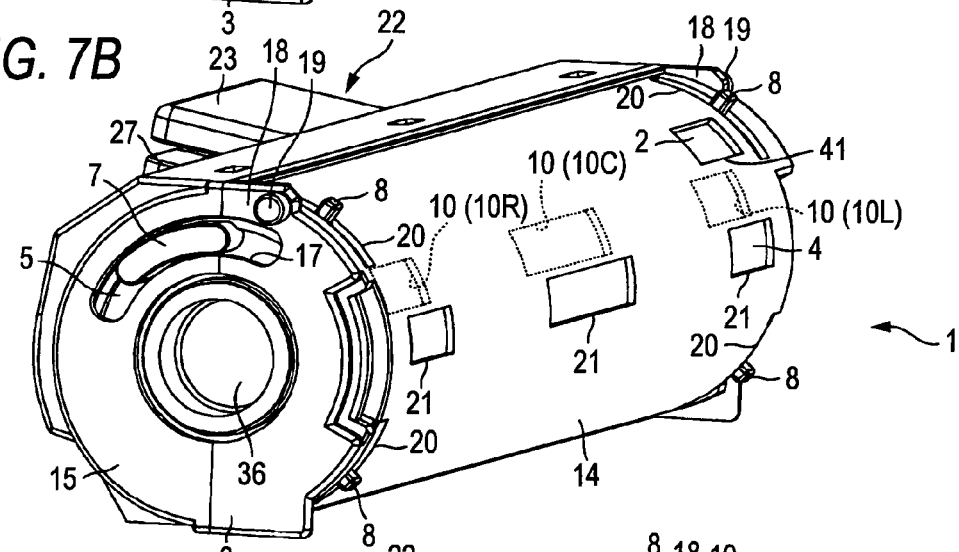
Figure 7C:
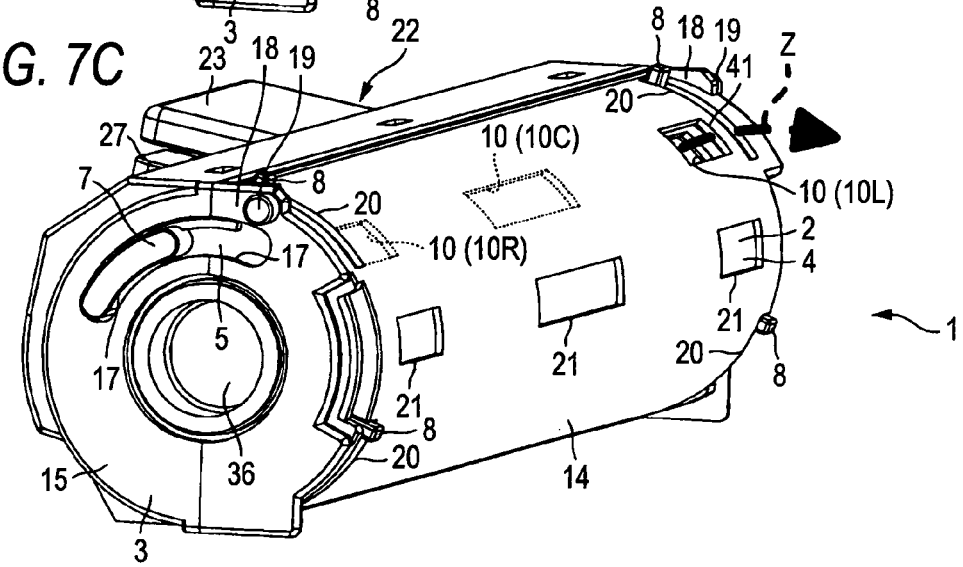

Referring to FIGS. 7A, 7B, and 7C, a developer cartridge according to still another exemplary embodiment of the present invention will be described.

According to this exemplary embodiment, the inside housing 2 is rotatable relatively to the outside housing 3 between the opened position (see FIG. 7A) and a discharge position (see FIG. 7C). The closed position (see FIG. 7B) is defined between the opened position and the discharge position.

In the outside housing 3 according to this exemplary embodiment, a discharge opening 41 is formed. Specifically, the discharge opening 41 is formed in a position opposed to the left inside passage opening 10L when the inside housing 2 is in the discharge position, that is, in the left end portion of the outside peripheral wall 14 (see FIG. 7C). The discharge opening 41 is substantially as large as the left inside passage opening 10L.

As shown in FIG. 7A, when the inside housing 2 is in the opened position, the discharge opening 41 is closed by a part of the inside peripheral wall 4 above the left inside passage opening 10L while all the inside passage openings 10 are opened.

Then, when the inside housing 2 is rotated toward the closed position as shown in FIG. 7B, all the inside passage openings 10 are closed by a part of the outside peripheral wall 14 above the outside passage openings 21.

When the inside housing 2 having reached the closed position is further rotated, the inside housing 2 is situated in the discharge position as shown in FIG. 7C. In the discharge position, only the left inside passage opening 10L is opposed to the discharge opening 41 to open while the inside passage openings 10 other than the left inside passage opening 10L is still closed.

As described above, according to this exemplary embodiment, the left inside passage opening 10L can be opened when the inside passage openings 10 other than the left inside passage opening 10L functioning also an example of the third opening are closed.

When all the inside passage openings 10 are opened by situating the inside housing 2 in the opened position and developer is discharged from the inside housing 2 through these plurality of inside passage openings 10 during recycling of the developer cartridge 1 (see FIG. 7A), the passage cross section of the swirling flow Z over the entire area of the inside passage openings 10 may be increased, and thus the speed of the swirling flow Z may be decreased. If the speed of the swirling flow Z is decreased, it may be difficult to discharge the developer by the swirling flow Z.

In contrast, if only the left inside passage opening 10L is opened by situating the inside housing 2 in the discharge position and developer is discharged from the left inside passage opening 10L during recycling of the developer cartridge 1 (see FIG. 7C), the passage cross section of the swirling flow Z at the left inside passage opening 10L can be suppressed so as to be comparatively small. Accordingly, the speed of the swirling flow Z can be held comparatively fast, and the developer can be effectively discharged by the swirling flow Z.

The right round hole 28R is formed in the right end portion of the inside housing 2 as mentioned above (see FIG. 1A), whereas the left inside passage opening 10L is formed in the left end portion of the inside housing 2. Accordingly, when air is blown into the inside housing 2 through the right round hole 28R, the swirling flow Z generated by the air thoroughly spreads all over the inside of the inside housing 2 in the width direction, so that the developer remaining in the inside housing 2 can be effectively discharged by the swirling flow Z.

In each of the above-described exemplary embodiments, the swirling flow Z, which has reached the side of the left inside passage opening 10L from the side of the right round hole 28R, is directed to the left inside passage opening 10L by the contact with the opposed part 39 of the inner wall surface of the inside housing 2 (see FIG. 2C) as described above. Thereby, the developer carried on the swirling flow Z can be effectively discharged from the left inside passage opening 10L.

(4) Fourth Modification

In the above-described exemplary embodiments, the space between the shaft insertion part 29 and the inner surface of the boss part 6 (see for example FIG. 1A) may be closed by a sheet made of, for example, resin, instead of the support parts 31. In such a case, the sheet may be provided with perforations (or cuts) along the outline of the gap between where the support parts 31 would be located. Accordingly, during recycling of the developer cartridge 1, the sheet may be torn along the perforations to form an opening through which air is injected, for example, by inserting the air injection nozzle into the perforations.

Additionally, it is also possible to form the perforations in the cap 36. If the perforations are formed in the cap 36, the support parts 31 can be formed by pushing the nozzle into the cap 36 without removing the cap 36.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developer cartridge comprising:

a cartridge housing that is configured to accommodate developer, the cartridge housing comprising:

a first opening for discharging the developer from the cartridge housing; and a second opening for accommodating the developer into the cartridge housing; and a deflector that is configured to generate a swirling flow of air in the cartridge housing.

2. The developer cartridge according to claim 1, wherein the deflector is provided in the cartridge housing and is located in a position between the first opening and the second opening.

3. The developer cartridge according to claim 1, wherein the cartridge housing comprises an inclined portion, the inclined portion being located on an opposite side of the cartridge housing from the first opening.

4. The developer cartridge according to claim 3, wherein the inclined portion is inclined in a region located over the first opening.

5. The developer cartridge according to claim 1, further comprising:

an agitating member that is accommodated in the cartridge housing and is configured to agitate the developer, wherein the deflector comprises a support part that supports a rotation shaft of the agitating member, wherein the support part extends in a direction away from the rotation shaft, and wherein the support part comprises an inclined surface inclined with respect to both a first plane including an axial direction of the rotation shaft and a second plane including a direction orthogonal to the axial direction.

6. The developer cartridge according to claim 5, wherein the cartridge housing further comprises a transmitting part that is configured to transmit a driving force to the agitating member, and wherein the second opening is provided in one end portion of the cartridge housing and the transmitting part is provided in another end portion of the cartridge housing.

7. The developer cartridge according to claim 1, further comprising:

an agitating member that is accommodated in the cartridge housing and is configured to agitate the developer, wherein the deflector comprises a blade part that is rotatably supported by a rotation shaft of the agitating member, and wherein the blade part comprises an inclined surface inclined with respect to both a first plane including an axial direction of the rotation shaft and a second plane including a direction orthogonal to the axial direction.

8. The developer cartridge according to claim 7, wherein the blade part is integrally provided with the agitating member.

9. The developer cartridge according to claim 7, wherein the cartridge housing further comprises a transmitting part that is configured to transmit a driving force to the agitating member, and wherein the second opening is provided in one end portion of the cartridge housing and the transmitting part is provided in another end portion of the cartridge housing.

10. The developer cartridge according to claim 1, wherein the cartridge housing further comprises a side wall, wherein the deflector comprises a tube provided in the side wall between a center axis of the cartridge housing and an outside edge of the side wall such that the tube provides communication from outside the cartridge housing to an inside of the cartridge housing, and wherein the tube extends so as to be inclined with respect to both a first plane including an axial direction of the cartridge housing and a second plane including a direction orthogonal to the axial direction.

11. The developer cartridge according to claim 1, wherein the cartridge housing further comprises:

a plurality of first openings for discharging the developer from the cartridge housing including the first opening;

an inside housing that is configured to accommodate the developer and comprises the plurality of first openings and the second opening; and an outside housing that accommodates the inside housing and opens and closes the plurality of first openings, and wherein the inside housing comprises a third opening that is configured to discharge the developer from the inside housing, the third opening configured to be opened when the first openings are closed.

12. The developer cartridge according to claim 11, wherein the second opening is provided in one end portion of the inside housing, and wherein the third opening is provided in another end portion of the inside housing.

13. The developer cartridge according to claim 12, wherein the inside housing comprises an inclined portion, the inclined portion being located on an opposite side of the inside housing from the third opening.

14. The developer cartridge according to claim 12, wherein the inclined portion is inclined in a region located over the third opening.

15. A developer cartridge comprising:

a cylindrical housing that is configured to accommodate developer;

at least one rectangular first opening provided in a wall of the cylindrical housing for discharging the developer from the cylindrical housing;

a second opening, which is provided at an axial end of the cylindrical housing, for accommodating the developer into the cylindrical housing; and a deflector that is configured such that when air is injected into the second opening, the deflector generates a swirling flow of air in the cylindrical housing.

16. A developer cartridge comprising:

a cartridge housing that is configured to accommodate developer;

a first opening for discharging the developer from the cartridge housing;

a second opening for accommodating the developer into the cartridge housing; and means for, when air is injected into the cartridge housing, generating a swirling flow of air in an interior of the cartridge housing.

17. A method of recycling a developing cartridge, the developing cartridge comprising a cartridge housing that is configured to accommodate developer, a first opening for discharging the developer from the cartridge housing, a second opening for accommodating the developer into the cartridge housing, and a deflector, the method comprising:

injecting air into the second opening such that the air is deflected by the deflector; and refilling the developing cartridge with developer.

* * * * *